US005545053A

United States Patent [19]

Ishii et al.

[11] Patent Number: 5,545,053

[45] Date of Patent: Aug. 13, 1996

[54] MULTI-POLE CONNECTOR

[75] Inventors: Takashi Ishii; Tamio Watanabe; Toru Nagano, all of Shizuoka, Japan

[73] Assignee: Yazaki Corporation, Tokyo, Japan

[21] Appl. No.: 503,491

[22] Filed: Jul. 18, 1995

Related U.S. Application Data

[63] Continuation of Ser. No. 186,147, Jan. 25, 1994, Pat. No. 5,480,322.

[30] Foreign Application Priority Data

Jan. 25, 1993 [JP] Japan ..... 5-9824

[51] Int. Cl.[6] ..... H01R 13/629

[52] U.S. Cl. ..... 439/364; 439/701

[58] Field of Search ..... 439/378, 379, 439/540.1, 680, 364, 701

[56] References Cited

U.S. PATENT DOCUMENTS

| | | | |
|---|---|---|---|
| 3,447,036 | 5/1969 | Dore et al. | 439/364 |
| 4,820,204 | 4/1989 | Batty | 439/701 |
| 4,923,411 | 5/1990 | Hayashi et al. | 439/540.1 |
| 4,952,166 | 8/1990 | Nagasaka et al. | 439/364 |
| 5,000,693 | 3/1991 | Hatagishi et al. | 439/248 |
| 5,073,127 | 12/1991 | Daly et al. | 439/701 |
| 5,378,173 | 1/1995 | Hashizawa | 439/701 |

FOREIGN PATENT DOCUMENTS

| | | | |
|---|---|---|---|
| 0326350 | 1/1989 | European Pat. Off. . | |
| 619625 | 10/1994 | European Pat. Off. | 439/701 |
| 62-145671 | 6/1987 | Japan . | |
| 3101879 | 10/1991 | Japan . | |

*Primary Examiner*—Gary F. Paumen

*Attorney, Agent, or Firm*—Sughrue, Mion, Zinn, Macpeak & Seas

[57] ABSTRACT

To provide a multi-pole connector in which projected male connectors are protected from interference from the outside, and a smooth fitting of the connectors can be achieved. In the multi-pole connector, male connectors are mounted on one frame in such a manner that the male connectors are projected from the frame, and female connectors for the male connectors are mounted on the other frame. Connector-protecting ribs are formed at a peripheral portion of the one frame, and are projected to a height equal to or higher than a height of distal ends of the male connectors, and rib reception guides for the ribs are formed on the other frame.

4 Claims, 3 Drawing Sheets

MULTI-POLE CONNECTOR

This is a continuation of aplication Ser. No. 08/186,147, filed Jan. 25, 1994, now Pat. No. 5,480,322 issued Jan. 2, 1996.

BACKGROUND OF THE INVENTION

1. Field of Invention

This invention relates to a multi-pole connector which has ribs for protecting projected male connectors, and rib-reception, guides for guiding the ribs so as to smoothly effecting the fitting of the connectors.

2. Related Art

FIG. 4 is an exploded perspective view of a multi-pole connector disclosed in Japanese Patent Unexamined Publication No. 62-145671, and FIG. 5 is a perspective view showing this connector in its assembled condition.

In this multi-pole connector 31, a square frame 33 is formed integrally on a peripheral portion of a main connector 32, and split-type sub-connectors 35 are inserted into openings 34 of the frame 33, and are retained relative to these openings. Distal ends 35*a* of the sub-connectors 35 are projected to be flush with a distal end of the main connector 32. Terminal retaining spacers (not shown) are inserted respectively to sides 36, and in this condition the sub-connectors 35 are fitted, together with the main connector 32, in a mating multi-pole connector (not shown) through a threaded operation.

In the above conventional construction, however, when the multi-pole connector 31 having the sub-connectors 35 attached thereto drops, or when something strikes against the sub-connector 35, the sub-connector 35 is disengaged from the frame 33, and is broken. Furthermore, when the multi-pole connector 31 is to be fitted through a threaded operation, the mating multi-pole connector is liable to be shifted out of phase in a direction of angular movement about a central nut boss 37, which results in a problem that a smooth fitting of the connector can not be effected.

SUMMARY OF THE INVENTION

With the foregoing in view, it is an object of this invention to provide a multi-pole connector in which a male connector projected from a frame will not drop or will not be disengaged or broken by interference from the outside, and a smooth fitting of the connector can be carried out.

To achieve the above object, the present invention provides a split multi-pole connector wherein male connectors are mounted on one frame in such a manner that the male connectors are projected from the frame, and female connectors for the male connectors are mounted on the other frame, wherein connector-protecting ribs are formed at a peripheral portion of the one frame, and are projected to a height equal to or higher than a height of distal ends of the male connectors; and rib reception guides for the ribs are formed on the other frame.

The connector-protecting ribs surround the male connectors to protect them against interference from the outside. When the connectors are to be fitted together, the ribs provided at the peripheral portion of the frame are fitted respectively in the rib reception guides of the other frame to prevent the angular movement of the connectors, thereby enabling a smooth fitting.

DETAILED DESCRIPTION OF THE PREFERRED EMBODIMENTS

Figure 1:
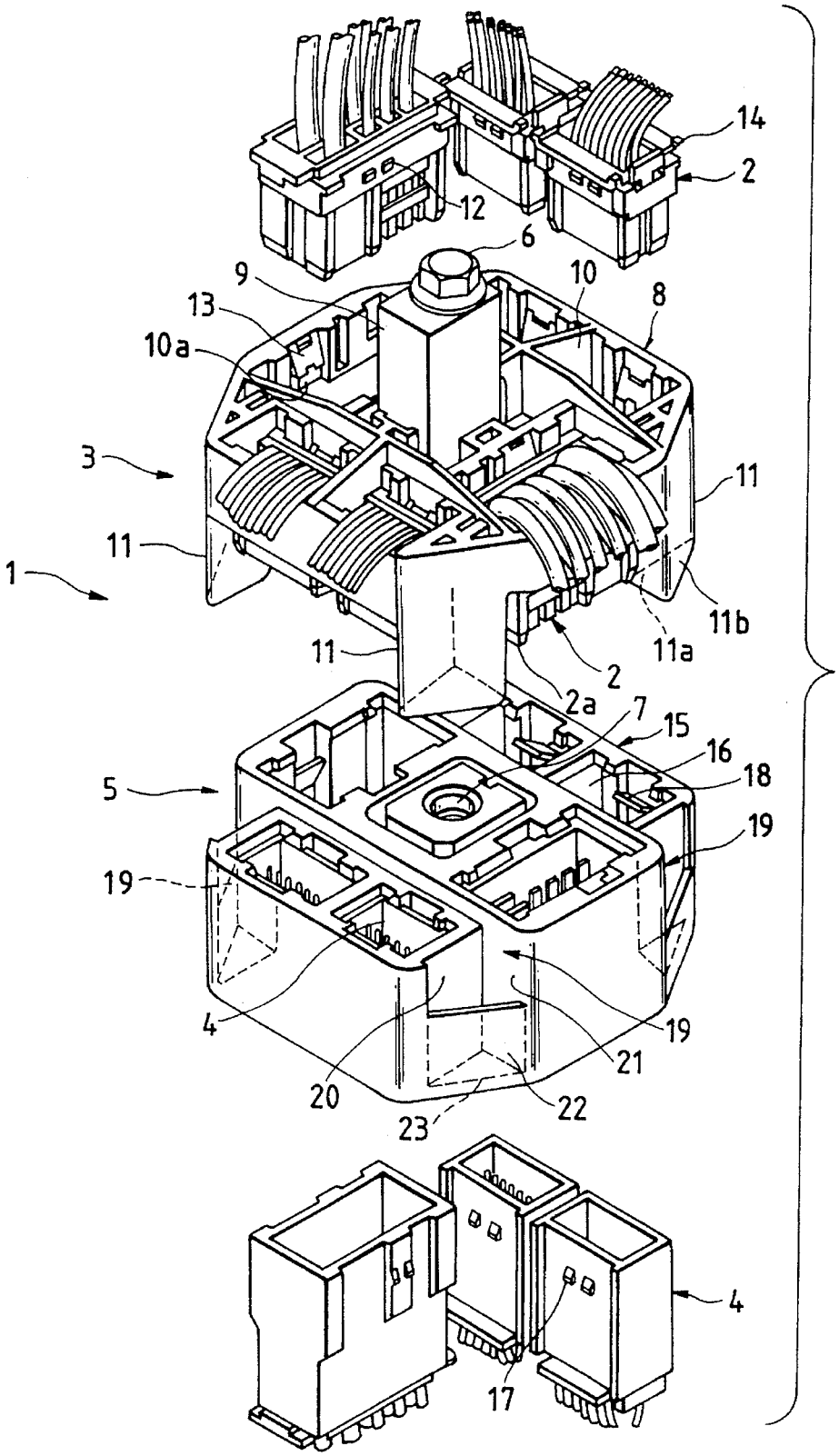
FIG. 1 is an exploded perspective view of one preferred embodiment of a multi-pole connector of the present invention.

FIG. 1 is an exploded perspective view of one preferred embodiment of a multi-pole connector of the present invention.

This multi-pole connector 1 comprises a male multi-pole connector 3 having a plurality of split-type male connectors 2 attached thereto, and a female multi-pole connector 5 having a plurality of split-type female connectors 4. The two multi-pole connectors 3 and 5 are fitted together through a threaded operation by a bolt 6, rotatably extending through the male multi-pole connector 3, and a nut 7 fixedly mounted on the female multi-pole connector 5.

Figure 2:
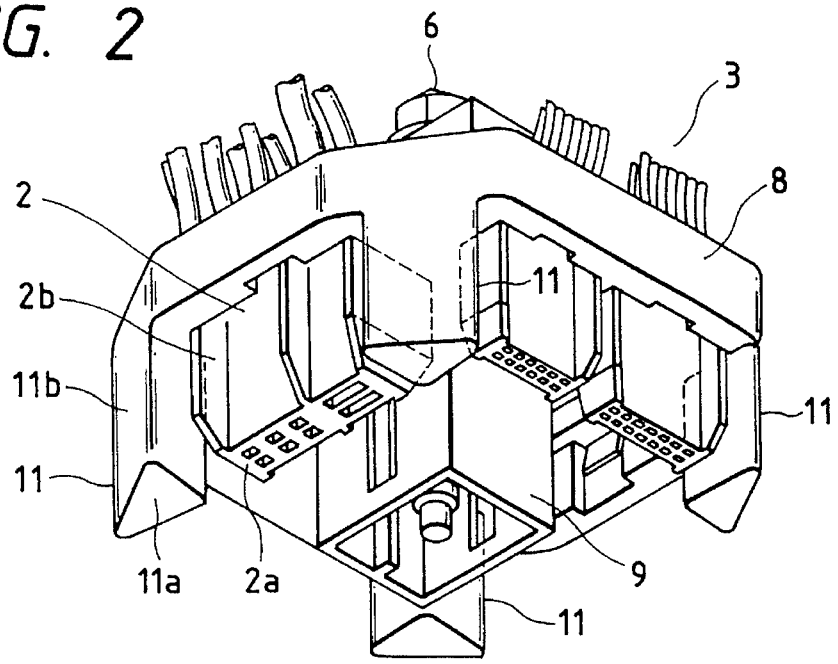
FIG. 2 is a perspective view of a male multi-pole connector.

As shown in FIG. 2, the male multi-pole connector 3 has a generally rectangular frame 8 of a synthetic resin into which the plurality of split-type male connectors 2 are inserted in such a manner that these connectors 2 are projected from the frame 8. The frame 8 has an integral bolt boss 9 at its central portion, and also has a plurality of connector insertion openings 10 around this bolt boss. Ribs 11 of a triangular prism-shape (which are a first feature of the present invention) for protecting the male connectors are integrally formed upright at four corners of the frame 8, respectively. Distal ends 11*a* of the ribs 11 are projected slightly beyond distal ends 2*a* of the male connectors 2, and outer surfaces 11*b* of the ribs 11 are disposed outwardly of side surfaces 2*b* of the male connectors 2 in generally surrounding relation to the male connectors 2. The distal end 11*a* of the rib 11 is at least set to a height equal to that of the distal end 2*a* of the male connector 2.

A lock pawl 13 for retaining projections 12 on the side wall 2*b* of the male connector 2 is formed integrally on an inner wall 10*a* of the opening in the frame 8. The male connector 2 is inserted into the opening 10, and a stop projection 14 at a rear end of this connector is abutted against a step portion (not shown) in the opening 10, and at the same time the retaining projections 12 slides over the lock pawl 13, and are engaged therewith, so that the male connector is retained against upward and downward movement. The male connector 2 is much projected from the frame 8 in the inserting direction, but is protected by the protective ribs 11 from a striking force or interference at the time of drop.

On the other hand, the female multi-pole connector 5 into which the male multi-pole connector 3 is fitted through a threaded operation has a frame 15 of a synthetic resin having openings 16 in which the plurality of female connectors for the male connectors 2 are provided. Like the male connector 2, the female connector 4 has retaining projections 17 which are engaged with a lock pawl 18 in the frame opening 16 so as to retain the female connector.

Rib reception guides 19 for the ribs 11 of the male multi-pole connector 3 are formed integrally at four corners of the frame 15, respectively. The rib reception guides 19 form a second feature of the present invention, and the rib reception guide 19 is formed by extending an outer wall 22 to a height about half of that of the frame 15, the outer wall 22 forming one side of a triangle defined by this outer wall and perpendicularly-intersecting side walls 20 and 21 of the frame 15. Further, a bottom wall 23 is formed integrally with these walls, so that the rib reception guide has a generally pocket-like configuration. The rib 11 can be fitted in the rib reception guide 19 without shaking.

Figure 3:
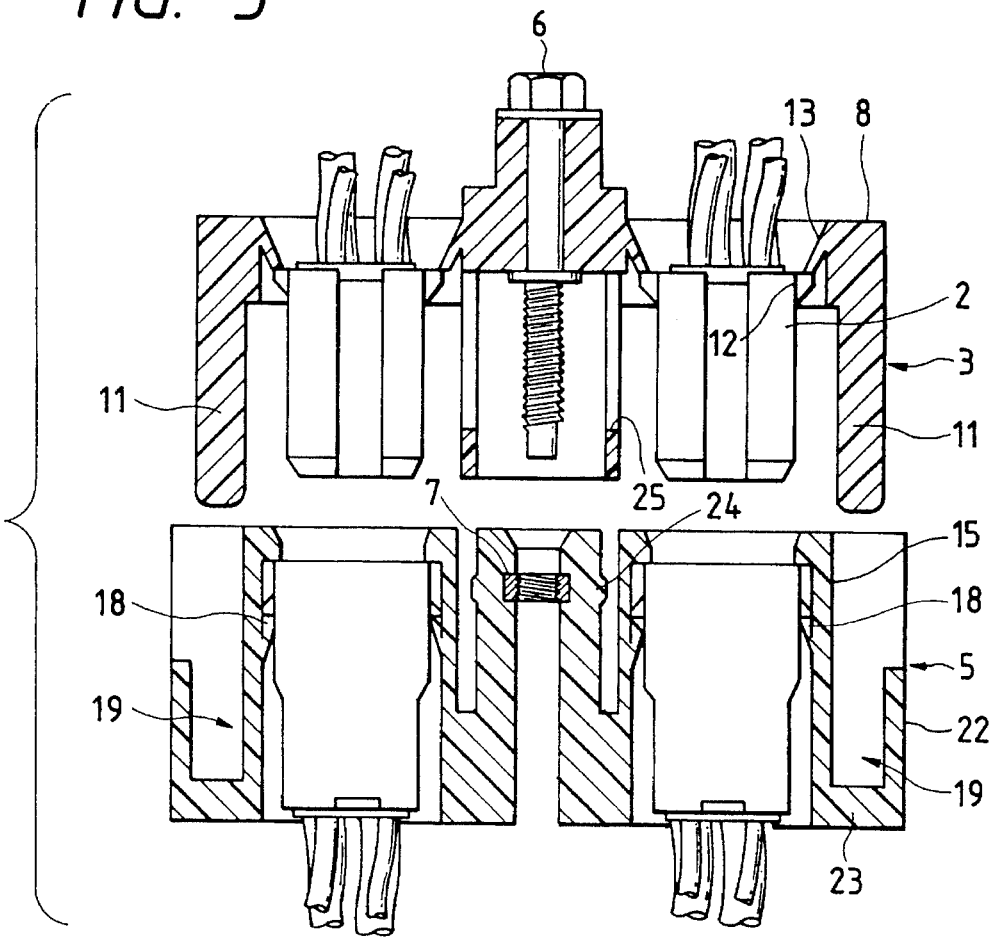
FIG. 3 is a vertical cross-sectional view showing the male and female multi-pole connectors.
Figure 4:
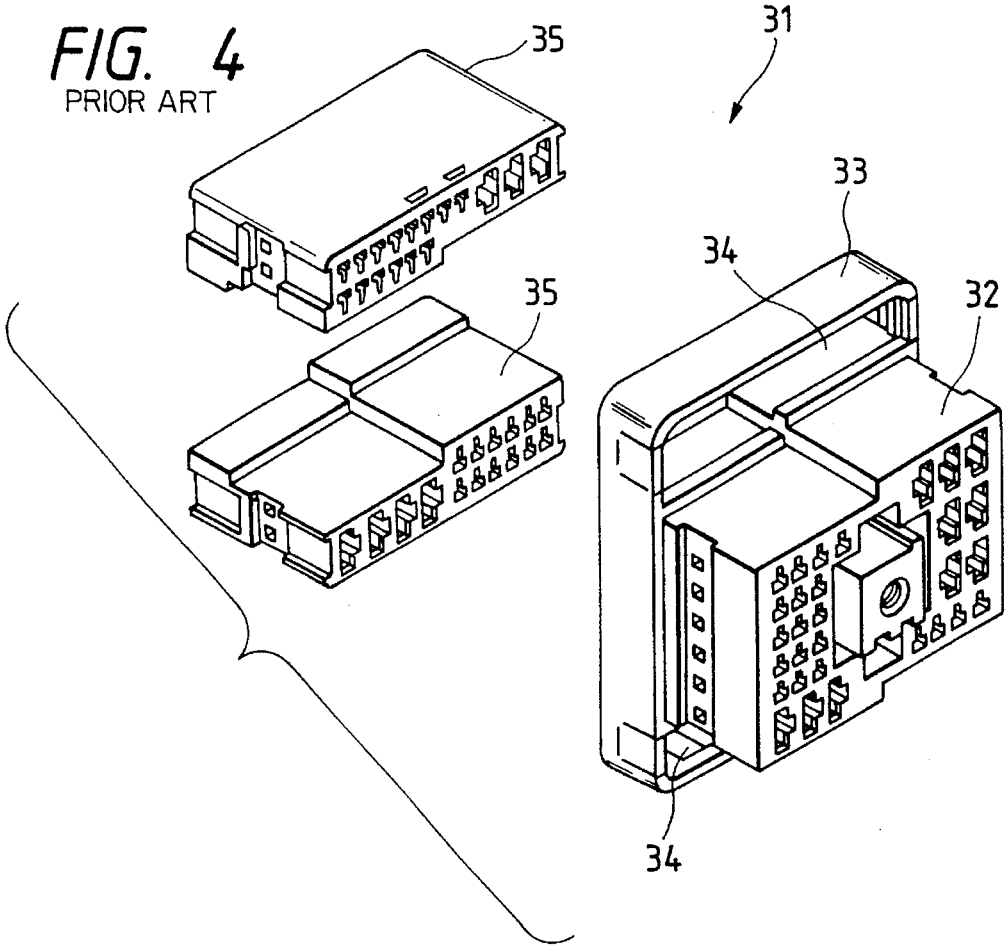
FIG. 4 PRIOR ART
FIG. 4 is an exploded perspective view of a conventional construction.
Figure 5:
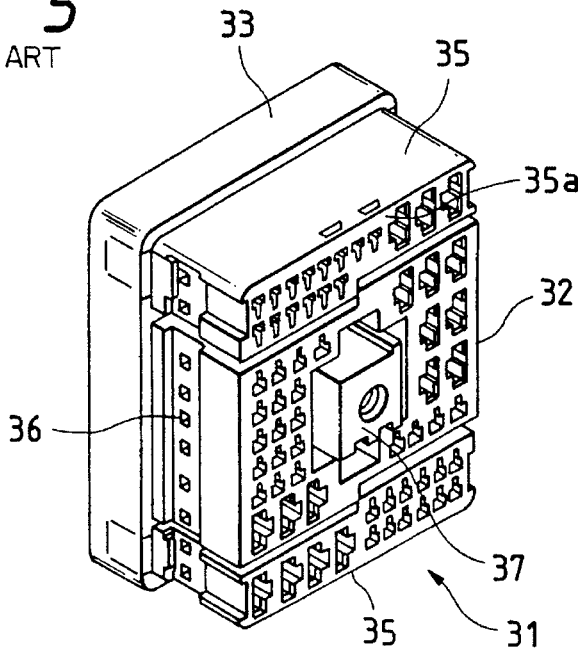
FIG. 5 PRIOR ART
FIG. 5 is a perspective view of the conventional construction in its assembled condition.

Provisionally-retaining projection 24 (FIG. 3) of the female multi-pole connector 5 are engaged respectively in engagement holes 25 of the male multi-pole connector 3, thereby provisionally retaining the two multi-pole connectors 3 and 5 relative to each other, and in this condition the bolt 6 is rotated to be threaded into the nut 7, so that the ribs 11 are engaged in the rib reception guides 19, respectively. As a result a phase shift in the direction of angular movement of the connectors is prevented, thereby achieving a smooth fitting of the connectors.

As described above, in the present invention, the ribs provided at the peripheral portion of the frame protect the male connectors, and therefore even when the connector drops or when an interference from the outside occurs, the male connectors will not be disengaged or broken. Moreover, when the connectors are to be fitted together, the ribs are guided by and engaged in the rib reception guides of the mating multi-pole connector, respectively, thereby preventing a phase shift in the direction of angular movement of the connector. Therefore, the fitting of the connectors can be effected smoothly without pinching the terminals. Since the ribs are provided at the peripheral portion of the frame, the shaking of the multi-pole connector can be kept to a minimum, and the connectors can be accurately positioned relative to each other.

What is claimed is:

1. A multi-pole connector assembly, comprising:

a first frame accommodating a plurality of first connectors projecting in a forward direction, each of said first connectors including a discrete housing retaining therein a plurality of first terminals, said first connectors being arranged in a cross-shaped arrangement including a first group arranged in a first lateral direction and a second group arranged in a second lateral direction perpendicular to said first lateral direction and combining to define four separate quadrants, said first frame including an alignment rib provided in each of said quadrants which projects in said forward direction;

a second frame accommodating a plurality of second connectors each including a discrete housing and a plurality of second terminals which are engageable with said first terminals therein, said second connectors also being arranged in a cross-shaped arrangement including a first group extending in said first lateral direction and a second group extending in said second lateral direction and combining to define four separate quadrants, said second frame having a rib reception guide provided in each of said quadrants for receiving an associated alignment rib of said first frame.

2. The multi-pole connector of claim 1, further comprising a fastener for fastening said first frame to said second frame.

3. The multi-pole connector of claim 2 wherein said fastener includes a screw provided in said first frame which is threadedly engageable with a threaded hole provided in said second frame.

4. The multi-pole connector of claim 3, wherein said screw is located at an intersection of said first and second groups of first connectors and said threaded hole being located at an intersection of said first and second groups of second connectors.

* * * * *